US009291171B2

(12) United States Patent
Bunel et al.

(10) Patent No.: US 9,291,171 B2
(45) Date of Patent: Mar. 22, 2016

(54) DIFFUSER-GUIDE VANE CONNECTION FOR A CENTRIFUGAL COMPRESSOR

(75) Inventors: Jacques Marcel Arthur Bunel, Thiais (FR); Sandrine Gandelot, Montrouge (FR); Guy Vieillefond, Morsang sur Orge (FR)

(73) Assignee: SNECMA, Paris (FR)

( * ) Notice: Subject to any disclaimer, the term of this patent is extended or adjusted under 35 U.S.C. 154(b) by 727 days.

(21) Appl. No.: 13/522,854

(22) PCT Filed: Jan. 19, 2011

(86) PCT No.: PCT/FR2011/050092

§ 371 (c)(1), (2), (4) Date: Aug. 24, 2012

(87) PCT Pub. No.: WO2011/089355

PCT Pub. Date: Jul. 28, 2011

(65) Prior Publication Data

US 2012/0308374 A1 Dec. 6, 2012

(30) Foreign Application Priority Data

Jan. 19, 2010 (FR) ..... 10 50328

(51) Int. Cl.

| | |
|---|---|
| ***F04D 29/44*** | (2006.01) |
| ***F04D 29/62*** | (2006.01) |
| ***F01D 9/04*** | (2006.01) |
| ***F01D 25/24*** | (2006.01) |

(52) U.S. Cl.

CPC ..... *F04D 29/624* (2013.01); *F01D 9/04* (2013.01); *F01D 25/246* (2013.01); *F04D 29/441* (2013.01)

(58) Field of Classification Search

CPC ..... F04D 29/444; F04D 29/448
USPC ..... 415/208.3, 208.4; 60/751
See application file for complete search history.

(56) References Cited

U.S. PATENT DOCUMENTS

| | | | | |
|---|---|---|---|---|
| 5,052,891 | A * | 10/1991 | Burkholder | 416/198 A |
| 5,555,721 | A * | 9/1996 | Bourneuf et al. | 60/806 |
| 6,279,322 | B1 | 8/2001 | Moussa | |

(Continued)

FOREIGN PATENT DOCUMENTS

| | | |
|---|---|---|
| EP | 1 818 511 | 8/2007 |
| EP | 2 123 863 | 11/2009 |

(Continued)

OTHER PUBLICATIONS

International Search Report Issued May 19, 2011 in PCT/FR11/050092 Filed Jan. 19, 2011.

*Primary Examiner* — Nathaniel Wiehe
*Assistant Examiner* — Michael Sehn
(74) *Attorney, Agent, or Firm* — Oblon, McClelland, Maier & Neustadt, L.L.P.

(57) ABSTRACT

An assembly including a diffuser and an airflow rectifier at an outlet of a centrifugal compressor of a turbine engine, the diffuser being substantially in a shape of a radially positioned double annular disc, and the rectifier being a double toroidal part, arranged as an extension of the double disc of the diffuser and curved such as to divert the airflow in the downstream direction of the engine. The rectifier is attached to the diffuser by a connection positioned immediately adjacent to the contact surface of the two parts and is removable using a standard tool, excluding any other supporting mechanism.

11 Claims, 2 Drawing Sheets

(56) References Cited

U.S. PATENT DOCUMENTS

| | | | | |
|---|---|---|---|---|
| 6,280,139 | B1 | 8/2001 | Romani et al. | |
| 6,585,482 | B1 * | 7/2003 | Liotta et al. | 415/116 |
| 7,581,397 | B2 * | 9/2009 | Strangman et al. | 60/751 |
| 7,955,051 | B2 * | 6/2011 | Daguenet et al. | 415/208.3 |
| 2007/0036646 | A1 | 2/2007 | Nguyen et al. | |
| 2007/0183890 | A1 | 8/2007 | Nolcheff et al. | |
| 2009/0304502 | A1 | 12/2009 | Nolcheff | |

FOREIGN PATENT DOCUMENTS

| | | |
|---|---|---|
| WO | 01 18404 | 3/2001 |
| WO | 01 29424 | 4/2001 |

* cited by examiner

DIFFUSER-GUIDE VANE CONNECTION FOR A CENTRIFUGAL COMPRESSOR

BACKGROUND OF THE INVENTION

1. Field of the Invention

The field of the present invention is that of turbine engines and in particular compressors of these turbine engines.

2. Description of the Related Art

Aeronautical turbine engines conventionally consist of a group of assembled modules comprising, in the air circulation direction, one or more compressors, a combustion chamber, one or more turbines which drive the compressor or compressors via drive shafts by extracting power from the gas leaving the combustion chamber, and at the outlet either a nozzle into which the burned gasses are ejected to produce thrust or a free turbine which recovers the energy from the gas to produce mechanical power.

The compressors are conventionally either of the axial flow type where the air flows through them in a substantially axial direction from the inlet to the outlet, or of the centrifugal type where the air enters axially to emerge in a radial direction. In the case of a centrifugal compressor, the air is collected at the impeller outlet by a radial part called a diffuser, then transferred to a second part called a guide vane which returns the compressed air flow to a substantially axial direction before it is introduced into the combustion chamber.

Several configurations have been proposed for these parts on existing aeronautical turbine engines. Engines are known in which the guide vane consists of a part used in combination with the external compressor housing to form a duct to guide the flow. This type of guide vane has the drawback of an imperfect connection between the diffuser and the guide vane and a poor quality of seal at the guide vane.

Monoblock guide vanes are also known which are bolted to flanges linked to the structure of the engine, but these configurations are characterized by additional parts, which entails a penalty in terms of mass. Also these flanges can deform under the effect of vibration or thermal expansion and not ensure perfect continuity of the stream between the diffuser and the guide vane.

Finally monoblock guide vanes are known which are mounted directly onto the diffuser by a hooping type connection which joins the two parts rigidly. Hooping is the assembly of two parts by a shrink fit. The assembly is produced with machining tolerances which prevent its manual assembly or even assembly on a press, and generally means are required for heating or cooling the parts to be assembled. Although this solution brings a benefit in terms of mass and continuity of the stream, it is difficult to disassemble without suitable means and the solution cannot be produced by an operator equipped with conventional tooling only.

BRIEF SUMMARY OF THE INVENTION

The aim of the present invention is to rectify these drawbacks by proposing a device for connection between the diffuser and the guide vane which does not have at least some of the drawbacks of the prior art, and in particular is light, easy to assemble and disassemble, and guarantees good alignment of the air circulation ducts at the compressor outlet.

To this end the object of the invention is an assembly comprising a diffuser and a guide vane at the outlet from a centrifugal compressor of a turbine engine, said diffuser having substantially the form of a double annular disk oriented radially and said guide vane being a double toroidal part positioned in the extension of the double diffuser disk and curved to divert the air flow towards the downstream side of the engine, characterized in that said guide vane is fixed to said diffuser by a connection which is positioned immediately next to the contact surface of the two parts and can be disassembled using standard tooling, with the exclusion of any other means of support.

Such a connection eliminates the risk of misalignment of the two parts while remaining easy to disassemble without the operator needing to use means other than those usually available. Standard tooling must be understood as tooling which can be transported by the operator and is suitable for use at the turbine engine assembly or disassembly station.

Advantageously the connection is a connection by bolt and nut.

Preferably the diffuser comprises on one of its disks, at its contact surface with said guide vane, a flange parallel to said disk and delimiting with said disk a groove able to receive the head of said bolt and comprising at least one notch to allow passage of the stem of said bolt.

In a particular embodiment the guide vane, at its contact surface with said diffuser, comprises a toroidal ferrule, the section of which comprises a first L-shaped part which surrounds the end of the diffuser followed by a second part in the form of a flange which comes to surround the corresponding flange of the diffuser.

Advantageously the guide vane, at its surface intended to cooperate with the diffuser disk opposite the disk carrying said flange, comprises a toroidal ferrule with L-shaped section.

In another particular embodiment the diffuser, on its disk opposite that carrying said flange, comprises an L-shaped flange which extends axially towards the outside of the diffuser and projects radially so as to constitute a transverse stop flange for the guide vane.

Preferably the bolt on its head comprises a truncated part to constitute an anti-rotation element by cooperation with the base of the groove.

The invention also concerns a compressor module for a turbine engine comprising a diffuser-guide vane assembly as described above, and finally a turbine engine comprising such a diffuser-guide vane assembly positioned at the outlet from a centrifugal compressor.

The invention will be better understood and further objectives, details, characteristics and advantages thereof will appear more clearly during the detailed explanatory description below of one embodiment of the invention, given as a purely illustrative and non-limiting example with reference to the attached schematic drawings.

DETAILED DESCRIPTION OF THE INVENTION

Figure 1:
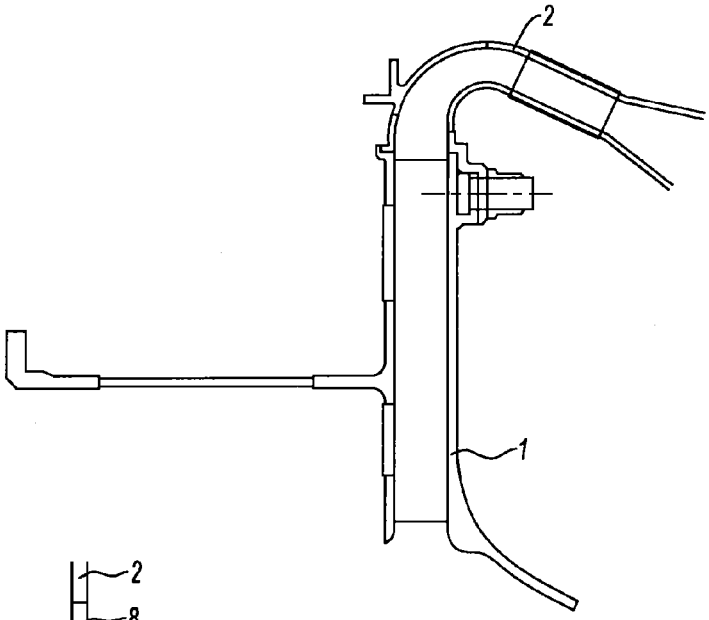
FIG. 1 is a section view of a diffuser-guide vane assembly for a centrifugal compressor according to one embodiment of the invention.

With reference to FIG. 1, a diffuser 1 placed at the outlet from the blade wheel of a centrifugal compressor (not shown) is visible, and a guide vane 2 which diverts the compressed air flow by around 120° to guide it in the direction of a combustion chamber, also not shown. The diffuser 1 has approximately the shape of a double annular disk oriented radially, in the center of which is inserted the impeller and which forms a compressed air collector duct. The guide vane 2 is a toroidal part with two faces which is positioned in the extension of the double diffuser disk and curved to divert the air flow to the downstream side of the engine (the downstream side being shown on the right on FIG. 1).

Figure 2:
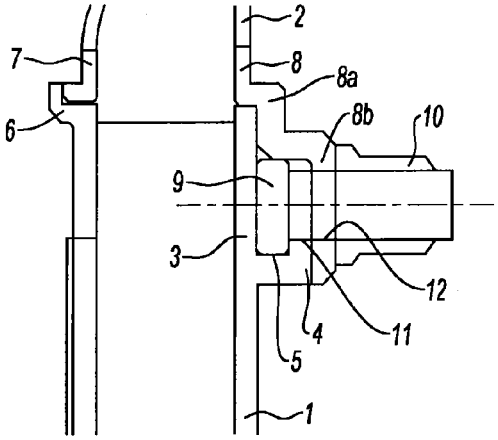
FIG. 2 is a section view of the diffuser-guide vane connection according to one embodiment of the invention.

With reference to FIG. 2, we see the detail of the connection between the diffuser 1 and the guide vane 2. The downstream disk 3 of the diffuser comprises a flange 4 positioned on the outside of the diffuser parallel to the downstream disk 3, which flange runs over the entire periphery of the disk and is connected to the downstream disk by a bridge so as to create a groove 5 between the flange 4 and the downstream disk 3.

On FIGS. 1 and 2, the flange 4 is positioned against the downstream disk i.e. at the disk accessible last on assembly in the present configuration; it is evident that this type of connection can comprise a flange 4 mounted on the upstream disk if the latter is accessible last on assembly of the engine.

On the upstream side, the disk of the diffuser 1 ends in an L-shaped flange 6 which first extends axially towards the outside of the diffuser so as not to disrupt the circulation of the air flow within said diffuser, then projects radially so as to constitute a transverse stop flange for the guide vane. It should be noted that throughout the present document, the term axial is used with reference to the axis of rotation of the rotating elements of the turbine engine and the direction of circulation of the gas flow.

The guide vane 2 is terminated at its junction with the diffuser 1 on the upstream side by a toroidal upstream ferrule 7 of L-shaped section, the axial extension of which cooperates with the L-shaped flange 6 of the diffuser, and on the downstream side by a downstream ferrule 8, also toroidal. The section of the downstream ferrule 8 has a first L-shaped part 8*a* which surrounds the end of the diffuser and continues in a second part 8*b* in the form of a flange which caps the corresponding flange 4 of the diffuser 1.

The guide vane 2 is held on the diffuser 1 by a bolt 9, the head of which is placed in the groove 5 and which extends perpendicular to the wall of the downstream disk 3. This bolt passes firstly through the flange 4 of the diffuser at a notch 11 made in said flange, and secondly through the second part 8*b* of the downstream ferrule 8 at a drill-hole 12. The assembly is clamped by a nut 10 which cooperates with the bolt 9 and rests on the second part 8*b*.

Figure 3:
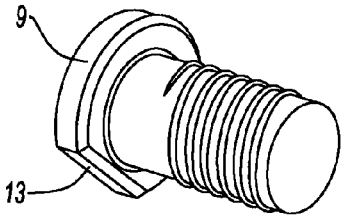
FIG. 3 is a perspective view of an assembly bolt of the diffuser-guide vane connection according to one embodiment of the invention.
Figure 4:
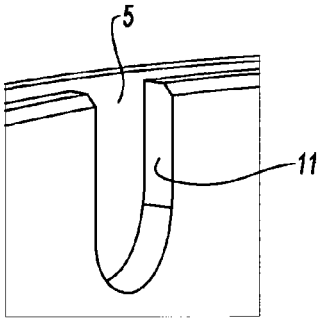
FIG. 4 is a perspective view of a notch in the diffuser flange for production of a connection according to one embodiment of the invention.

FIGS. 3 and 4 show the bolt 9, the head of which is truncated to produce a flat 13, and the notch 11 made in the wall of the flange 4 of the diffuser.

Figure 5:
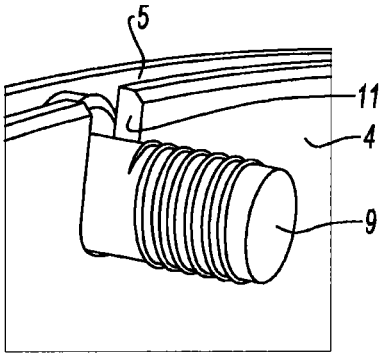
FIG. 5 is a perspective view of an assembly bolt in place in the groove of a diffuser for a connection according to one embodiment of the invention.
Figure 6:
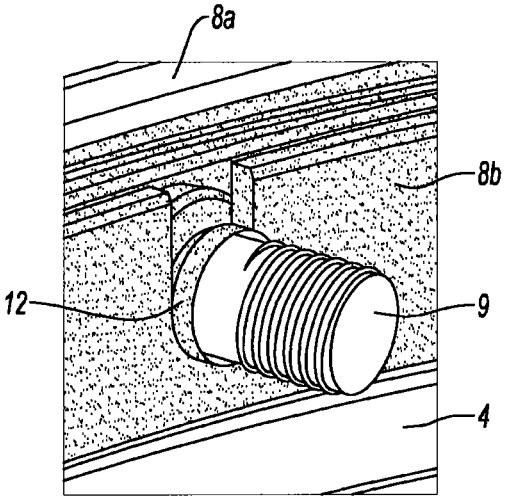
FIG. 6 is a perspective view of a diffuser-guide vane connection according to one embodiment of the invention before installation of the clamping nut.
Figure 7:
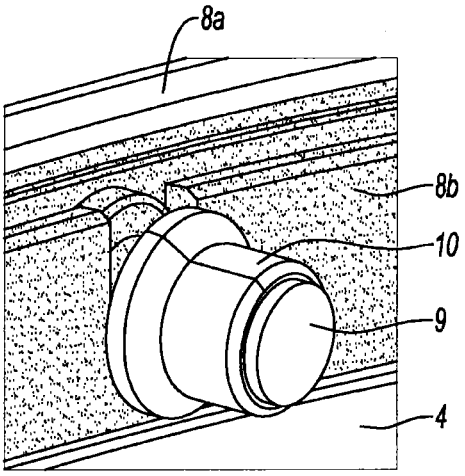
FIG. 7 is a perspective view of a diffuser-guide vane connection according to one embodiment of the invention after installation of the clamping nut.

FIGS. 5 to 7 show the sequence of operations for assembly of a guide vane 2 on a diffuser 1.

In FIG. 5, the head of the bolt 9 is positioned in the groove 5 of the diffuser 1 with its flat 13 against the base of the groove to ensure an anti-rotation function on tightening. The stem of the bolt 9 is positioned perpendicular to the flange 4 and passes through the notch 11 made in this flange.

In FIG. 6, the guide vane 2 has been installed on the diffuser 1 by an axial translation movement. For reasons of clarity of FIGS. 6 and 7, the downstream ferrule 8 is here shown transparently. The first part 8*a* of the ferrule extends backward in the extension of the downstream disk 3 while the second part 8*b* covers the flange 4 of the diffuser. The stem of the bolt 9 passes through the second part 8*b* via the drill-hole 12 provided to this end.

FIG. 7 shows the diffuser-guide vane assembly already assembled. The nut 10 is bolted to the stem of the bolt 9 and firmly connects the ferrule 8 of the guide vane with the flange 4 of the diffuser.

The improvements made to the function and use of a diffuser-guide vane assembly joined by a connection according to the invention will now be described, by comparison with known configurations of the prior art.

With regard to production of the two parts, the diffuser 1 is preferably produced from a part cut from a solid piece, the groove 5 being machined in an over-thickness left on the downstream disk 3. After the groove is machined, notches are then made in the flange of the diffuser and are a priori distributed regularly over the circumference of said flange.

The guide vane 2 is produced by a separate sheet which recreates the air stream, to which are welded or brazed the upstream ferrule 7 and downstream ferrule 8 which ensure the connection with the diffuser 1. This method of manufacture allows production of the guide vane independently of the other parts of the turbine engine, and in particular the possibility of recreation of the weld bead of the ferrules in the case of overflow of said bead, before assembly of the guide vane 2 on the diffuser 1. Thus it can be ensured that no burrs provoked by welding protrude into the air stream and disrupt the flow, causing undesirable pressure losses or turbulence.

The first improvement made by the invention lies in the perfect alignment of the two parts which remain aligned whatever the operating conditions and in particular whatever the vibration or thermal deformation level of the parts. This characteristic results from the shrink-fitting of the ferrule 8 of the guide vane between firstly the radial extension of the L-shaped flange 6 and secondly the flange 4 of the diffuser. The tightening of the bolt 9 furthermore applies a stress on this ferrule which is held by the L-shaped flange and pressed against the flange 4 by the nut 10. This application of stress guarantees good resistance of the ferrule 8 and the perfect alignment of the ducts which direct the air stream.

Also the guide vane 2 is mounted directly on the diffuser 1 without flanged connection to the structure of the engine, which prevents deformation due to flexibility of these support flanges as is found in the prior art. Similarly the positioning of the clamping means of the guide vane 2 as close as possible to its connection with the diffuser 1 contributes to this improvement in rigidity of assembly and constancy of alignment of the ducts. Thus the multiplicity of support devices for the guide vane and the associated mass are avoided.

Finally the principle of assembly by bolting guarantees the possibility of easy disassembly and consequently facilitates the replacement of the various elements which could be damaged during the life of the part.

Although the invention has been described in relation to a particular embodiment, it is evident that it comprises all technical equivalents of the means described and their combinations if falling within the context of the invention.

The invention claimed is:

1. An assembly comprising a diffuser and a guide vane at the outlet from a centrifugal compressor of a turbine engine, said assembly comprising:

a diffuser having approximately the form of a double annular disk oriented radially; and a guide vane being an upstream toroidal part and a downstream toroidal part, said guide vane positioned in an extension of the double annular disk of the diffuser and curved to divert air flow towards the downstream side of the turbomachine, wherein the guide vane is fixed to the diffuser by a connection which is positioned immediately next to a contact surface of the diffuser and the guide vane, which excludes any flanged connection to the structure of the engine and any other means of support, and which can be released using standard tooling.

2. The assembly as claimed in claim 1, wherein the connection is a connection by bolt and nut.

3. The assembly as claimed in claim 2, wherein the diffuser comprises on one of its disks, at its contact surface with the guide vane, a flange parallel to the disk and delimiting with the disk a groove configured to receive a head of the bolt and comprising at least one notch to allow passage of a stem of the bolt.

4. The assembly as claimed in claim 3, wherein the guide vane, at its contact surface with the diffuser, comprises a toroidal ferrule, a section of which comprises a first L-shaped part that surrounds an end of the diffuser followed by a second part in a form of a flange that surrounds a corresponding flange of the diffuser.

5. The assembly as claimed in claim 3, wherein the guide vane, at its surface configured to cooperate with the diffuser disk opposite the disk carrying the flange, comprises a toroidal ferrule with an L-shaped section.

6. The assembly as claimed in claim 3, wherein the diffuser, on its disk opposite that carrying the flange, comprises an L-shaped flange that extends axially towards an outside of the diffuser and projects radially so as to constitute a transverse stop flange for the guide vane.

7. The assembly as claimed in claim 6, wherein the guide vane, at its surface configured to cooperate with the diffuser disk opposite the disk carrying the flange, comprises a toroidal ferrule with an L-shaped section which abuts the L-shaped flange.

8. The assembly as claimed in claim 3, wherein the head of the bolt comprises a truncated part to constitute an anti-rotation element by cooperation with a base of the groove.

9. A compressor module for a turbine engine comprising a diffuser-guide vane assembly as claimed in claim 1.

10. A turbine engine comprising a diffuser-guide vane assembly as claimed in claim 1 at an outlet from a centrifugal compressor.

11. An assembly comprising a diffuser and a guide vane at the outlet from a centrifugal compressor of a turbine engine, said assembly comprising:

a diffuser having approximately the form of an upstream disk and a downstream disk oriented radially; and a guide vane being an upstream toroidal part and a downstream toroidal part positioned in an extension of the upstream disk and the downstream disk of the diffuser, respectively, and curved to divert air flow towards the downstream side of the turbomachine; and a bolt and a nut which connect the diffuser to the guide vane, wherein one of the upstream disk or the downstream disk includes a flange parallel to an outer face of the respective disk at a contact surface thereof with the guide vane, the flange extending radially outward and being connected to the respective outer face by a bridge so as to present a groove between the flange and the respective disk, wherein an inner radial end of the upstream toroidal part or the downstream toroidal part includes a ferrule, the ferrule including a first section which surrounds an outer radial end of the diffuser and a second section which includes a flange extending radially inward and surrounding the flange of the diffuser, wherein the flange of the diffuser includes a notch, and the flange of the ferrule of the guide vane includes a hole, and wherein the guide vane is fixed to the diffuser by the bolt and the nut, a head of the bolt is positioned in the groove, a stem of the bolt passing through the notch in the flange of the diffuser and the hole in the flange of the ferrule, and the nut is fastened to the stem of the bolt such that a first face of the flange of the ferrule abuts the flange of the diffuser and a second face of the flange of the ferrule abuts the nut.

* * * * *

UNITED STATES PATENT AND TRADEMARK OFFICE

CERTIFICATE OF CORRECTION

PATENT NO. : 9,291,171 B2
APPLICATION NO. : 13/522854
DATED : March 22, 2016
INVENTOR(S) : Jacques Marcel Arthur Bunel et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 734 days.

Signed and Sealed this
Fourteenth Day of June, 2016

Michelle K. Lee

Michelle K. Lee
*Director of the United States Patent and Trademark Office*